US011028674B2

(12) United States Patent
Malbrel et al.

(10) Patent No.: US 11,028,674 B2
(45) Date of Patent: Jun. 8, 2021

(54) MONITORING EXPANDABLE SCREEN DEPLOYMENT IN HIGHLY DEVIATED WELLS IN OPEN HOLE ENVIRONMENT

(71) Applicants: Christophe Malbrel, Houston, TX (US); John K. Wakefield, Cypress, TX (US)

(72) Inventors: Christophe Malbrel, Houston, TX (US); John K. Wakefield, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 196 days.

(21) Appl. No.: 16/050,734

(22) Filed: Jul. 31, 2018

(65) Prior Publication Data

US 2020/0040712 A1 Feb. 6, 2020

(51) Int. Cl.

| | |
|---|---|
| ***E21B 43/10*** | (2006.01) |
| ***E21B 47/09*** | (2012.01) |
| ***E21B 47/08*** | (2012.01) |

(52) U.S. Cl.

CPC ..... *E21B 43/108* (2013.01); *E21B 47/08* (2013.01); *E21B 47/09* (2013.01)

(58) Field of Classification Search

CPC .. E21B 43/08–108; E21B 47/09; E21B 47/08; E21B 47/085; E21B 47/095; E21B 47/02–024; E21B 36/00

See application file for complete search history.

(56) References Cited

U.S. PATENT DOCUMENTS

| | | | | |
|---|---|---|---|---|
| 8,225,867 | B2 | 7/2012 | Hartog et al. | |
| 2005/0205268 | A1* | 9/2005 | Engels | E21B 47/16 166/381 |
| 2006/0096105 | A1 | 5/2006 | Haugland | |
| 2007/0235185 | A1 | 10/2007 | Patel et al. | |

(Continued)

FOREIGN PATENT DOCUMENTS

| | | | |
|---|---|---|---|
| EP | 3147449 | A1 | 3/2017 |

OTHER PUBLICATIONS

International Search Report and the Written Opinion of the International Searching Authority; PCT/US2019/038379; dated Oct. 16, 2019; 8 pages total.

(Continued)

*Primary Examiner* — George S Gray

(74) *Attorney, Agent, or Firm* — Cantor Colburn LLP

(57) ABSTRACT

A method for deploying a sand screen in a borehole penetrating the earth includes: disposing the sand screen in an unexpanded form in the borehole, the sand screen at least partially surrounding a base-pipe; and activating the sand screen in the unexpanded form by applying at least one of an activation fluid and heat to the sand screen causing the sand screen to expand into an expanded form. The method further includes: conveying a downhole tool through the base-pipe, the downhole tool being configured to sense a property derived from at least one of expansion and non-expansion of the sand screen as a function of distance into the borehole to provide sensed data as a function of distance into the borehole; and identifying one of an expanded state and an unexpanded state of the sand screen using the sensed data as a function of distance into the borehole.

16 Claims, 5 Drawing Sheets

(56) References Cited

U.S. PATENT DOCUMENTS

| | | | | |
|---|---|---|---|---|
| 2010/0051262 | A1* | 3/2010 | Dusterhoft | E21B 47/01 166/236 |
| 2011/0011576 | A1 | 1/2011 | Cavender et al. | |
| 2011/0030467 | A1 | 2/2011 | Bakulin et al. | |
| 2011/0036565 | A1 | 2/2011 | Holderman et al. | |
| 2012/0325476 | A1 | 12/2012 | Brenneis et al. | |
| 2016/0160617 | A1 | 6/2016 | Garza et al. | |
| 2018/0023383 | A1 | 1/2018 | Hori et al. | |
| 2018/0266239 | A1* | 9/2018 | Jarrot | E21B 47/002 |
| 2019/0025450 | A1* | 1/2019 | Teague | E21B 47/16 |
| 2019/0383130 | A1 | 12/2019 | Fox et al. | |
| 2020/0157935 | A1 | 5/2020 | Patterson | |

OTHER PUBLICATIONS

International Search Report and the Written Opinion of the International Searching Authority; PCT/US2019/062322; dated Mar. 10, 2020; ISR 6 pages, WO 6 pages, 12 pages total.

International Search Report and the Written Opinion of the International Searching Authority; PCT/US2019/038379; dated Oct. 16, 2019; 8 pages.

Non-Final Office Action for U.S. Appl. No. 16/688,296; dated Jul. 27, 2020; 9 Pages.

* cited by examiner

MONITORING EXPANDABLE SCREEN DEPLOYMENT IN HIGHLY DEVIATED WELLS IN OPEN HOLE ENVIRONMENT

BACKGROUND

Production of hydrocarbons involves extracting hydrocarbon-bearing fluids from reservoirs in geologic formations. Typically, the hydrocarbon-bearing fluids are extracted via a base-pipe disposed in a borehole penetrating the formation. Unfortunately, sand may also enter the base-pipe and be pumped to the surface in a process referred to as sand production. Sand production can lead to several problems such as hardware erosion, blocking tubulars, and creating cavities that can lead to formation subsidence and casing collapse. In addition, sand that is produced at the surface must be separated and disposed. Hence, innovations that prevent or impede sand incursion into the base-pipe would be well received in the hydrocarbon production industry.

SUMMARY

Disclosed is a method for deploying a sand screen in a borehole penetrating the earth. The method includes: disposing the sand screen in an unexpanded form in the borehole, the sand screen at least partially surrounding a base-pipe; activating the sand screen in the unexpanded form by applying at least one of an activation fluid and heat to the sand screen causing the sand screen to expand into an expanded form; conveying a downhole tool through the base-pipe, the downhole tool being configured to sense a property derived from at least one of expansion and non-expansion of the sand screen as a function of distance into the borehole to provide sensed data as a function of distance into the borehole; and identifying, using a processor, one of an expanded state and an unexpanded state of the sand screen using the sensed data as a function of distance into the borehole.

Also disclosed is an apparatus for deploying a sand screen in a borehole penetrating the earth. The apparatus includes: a completion rig configured to apply at least one of an activation fluid and heat to a sand screen at least partially surrounding a base-pipe disposed in a borehole penetrating the earth, the at least one of the activation fluid and the heat causing the sand screen in an unexpanded form to expand into an expanded form; a downhole tool configured to be conveyed through the base-pipe and to sense a property derived from at least one of expansion and non-expansion of the sand screen as a function of distance into the borehole to provide sensed data as a function of distance into the borehole; and a processor configured to identify one of an expanded state and an unexpanded state of the sand screen using the sensed data as a function of distance into the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Disclosed are methods and apparatuses for deploying a sand screen in a borehole penetrating the earth. The sand screen is made of a shape memory material and covers a base-pipe for extracting hydrocarbons. In general, several sand screens are used to cover openings of the base-pipe. The shape memory material of the sand screen is in compressed form when it is applied to the exterior of the base-pipe at the surface. After the base-pipe and the sand screens are disposed in a borehole, an activating agent or fluid is applied to the compressed sand screens causing the sand screens to expand. The sand screens expand to fill the annulus between the base-pipe and a wall of the borehole. In some cases, however, one or more sand screens may not deploy or may not fully deploy (i.e., may not have completely filled the void in the annulus surrounding the base-pipe having the sand screen). The methods and apparatuses as disclosed herein provide for detecting those sand screens that have not deployed or have not fully deployed. Different techniques for detecting those not-deployed or not-fully deployed sand screens are disclosed using different downhole tools.

Figure 1:
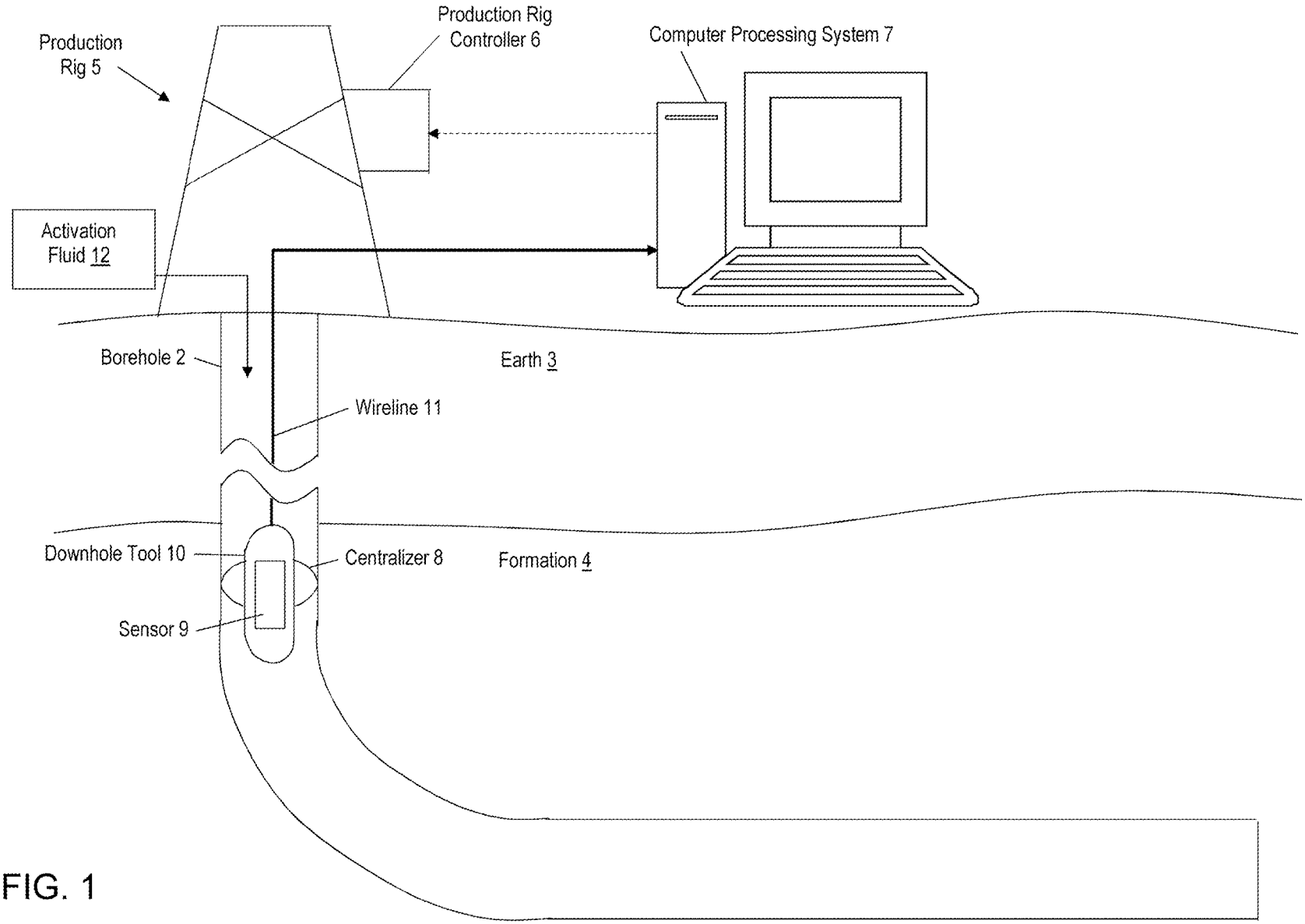
FIG. 1 illustrates a cross-sectional view of a deviated borehole penetrating the earth and a logging tool disposed therein.

FIG. 1 illustrates a cross-sectional view of a borehole 2 penetrating the earth 3 having a formation 4 that may include a reservoir of hydrocarbons. The borehole 2 is deviated at the lower end. A downhole tool 10 having a sensor 9 is configured to survey the borehole to provide reference survey data. The downhole tool 10 may include a centralizer 8 that is configured to urge the downhole tool 10 to the center line of the borehole 2 for performing the survey. In one or more embodiments, the survey includes measuring the inclination and/or azimuth of the borehole 2 as a function of distance into the borehole. Hence, a sensor 9 included in the downhole tool 10 may be configured to sense or measure the inclination and/or azimuth of the borehole 2 as a function of distance into the borehole. Non-limiting examples of the sensor 9 include an inclinometer and/or a magnetic compass-type or gyroscopic-type sensor. State of the art inclinometers and azimuth sensors can be accurate to one-tenth of a degree. Data sensed by the sensor 9 may be recorded downhole in the downhole tool 10 and/or recorded at the surface by a data recorder or a computer processing system 7.

A production rig 5 is configured to conduct completion operations such as, for example, deploying a base-pipe having sand screens in the borehole 2 and extracting hydrocarbons via the base-pipe. Other completion non-limiting operations include injecting or flowing an activation fluid 12 downhole to activate shape-memory sand screens so that they transition from a compressed state to an expanded state. An exemplary shape-memory sand screen may be one of the polyurethane class made into a foam with a home state due to its chemical crosslinks. A temporary, compressed state may be provided by heating the material above its glass transition temperature into a rubbery state, applying a load to pack the polymer chains more tightly around a base-pipe or tubular, cooling, and then removing the load. The compact shape-memory material is run downhole in a completion well. The temporary rigid state may be induced to the home state by heat and/or plasticization. Activation fluids are smaller, typically polar, molecules that can absorb into the polyurethane and plasticize or loosen the frozen polymer chains, effectively lowering the material's glass transition temperature. Sufficient activation fluid is pumped into the well to lower the glass transition temperature of the shape-memory material below the temperature of the well, allowing the polyurethane to expand to its home state and reach the borehole wall. A production rig controller 6 is configured to control completion operations performed by the production rig 5. The production rig controller 6 may receive data or instructions from the computer processing system 7 based on processing data received from the downhole tool 10. In one or more embodiments, the production rig 5 is configured to expand the shape-memory sand screen in the compressed state by applying an activation fluid and/or heat (such as electrically by a wireline for example) to the shape-memory sand screen.

Figure 2:
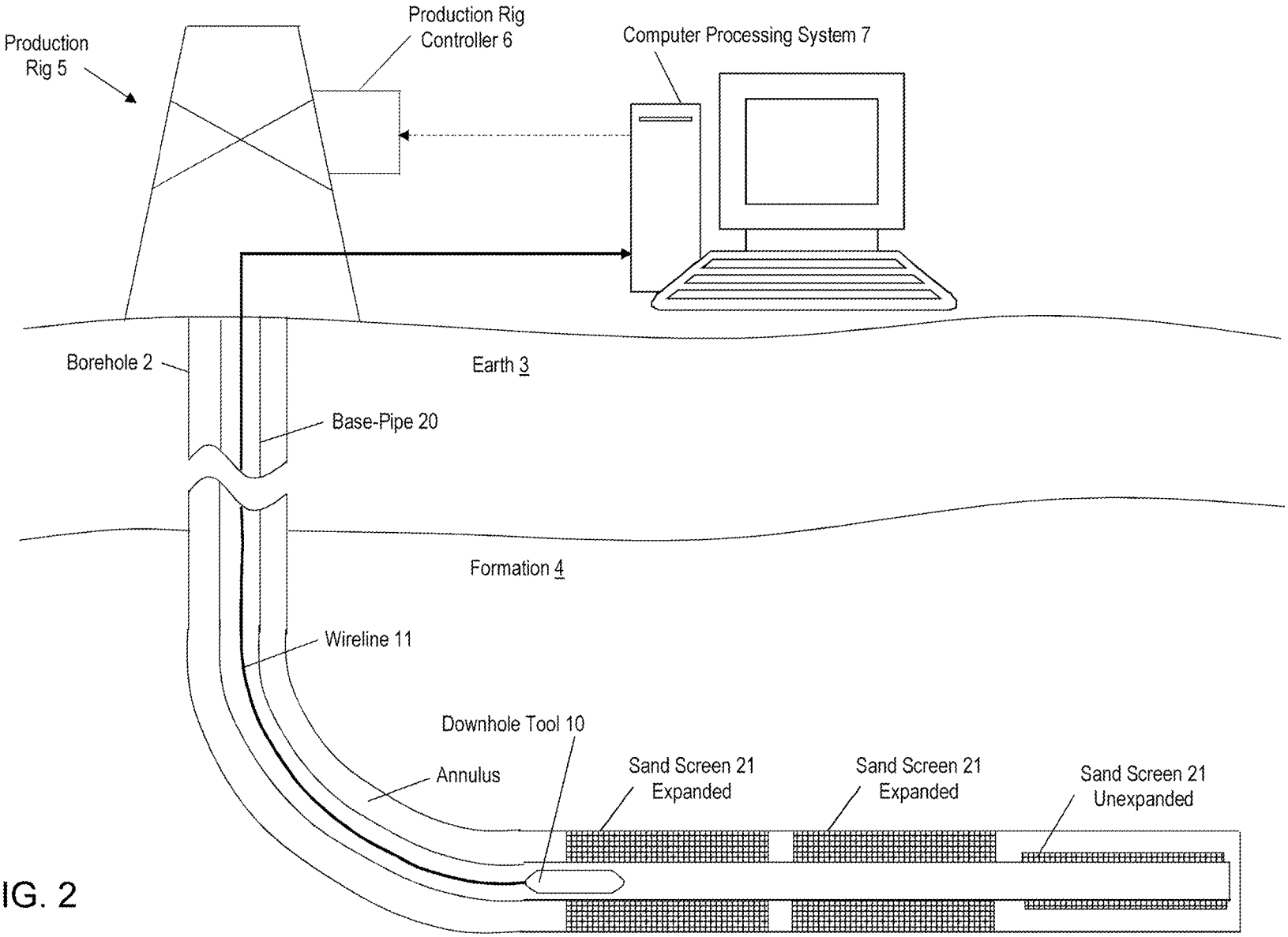
FIG. 2 illustrates a cross-sectional view of a production system having a sand screen covering a base-pipe.

FIG. 2 illustrates a base-pipe 20 disposed in the borehole 2. Sand screens 21 cover perforations in the base-pipe 20 to prevent or limit incursion of sand or debris into the base-pipe 20. In the embodiment of FIG. 2, two base-pipes 20 are illustrated in an expanded state and one sand screen 21 is illustrated in an unexpanded state. In one or more embodiments, the downhole tool 10 illustrated in FIG. 2 is configured to be conveyed in the base-pipe 20 and to perform survey measurements such as inclination and/or azimuth measurements as a function of distance into the borehole 2. These survey measurements may be referred to as sand screen deployment survey data.

Figure 3:
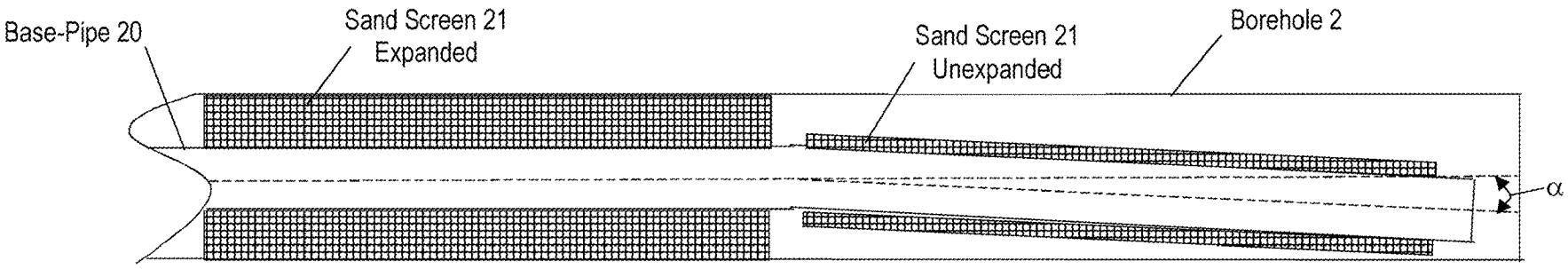
FIG. 3 depicts aspects of one sand screen that has not expanded.

As illustrated in FIG. 3, the unexpanded sand screen 21 may cause the base-pipe 20 to sag in the deviated end due to gravity. In the embodiment of FIG. 3, the base-pipe 20 sags $\alpha°$ because of the unexpanded sand screen 21. Hence, by comparing the sand screen deployment survey data to the reference survey data one or more unexpanded sand screens at a certain distance into the borehole 2 can be detected when the sand screen deployment data differs from the reference survey data by more than a threshold amount at a distance in the borehole corresponding to the distance of the sand screen 21 in the borehole 2. The threshold amount can be selected to account for sensor noise. In one or more embodiments, the threshold amount can be one or two degrees.

Figure 4:
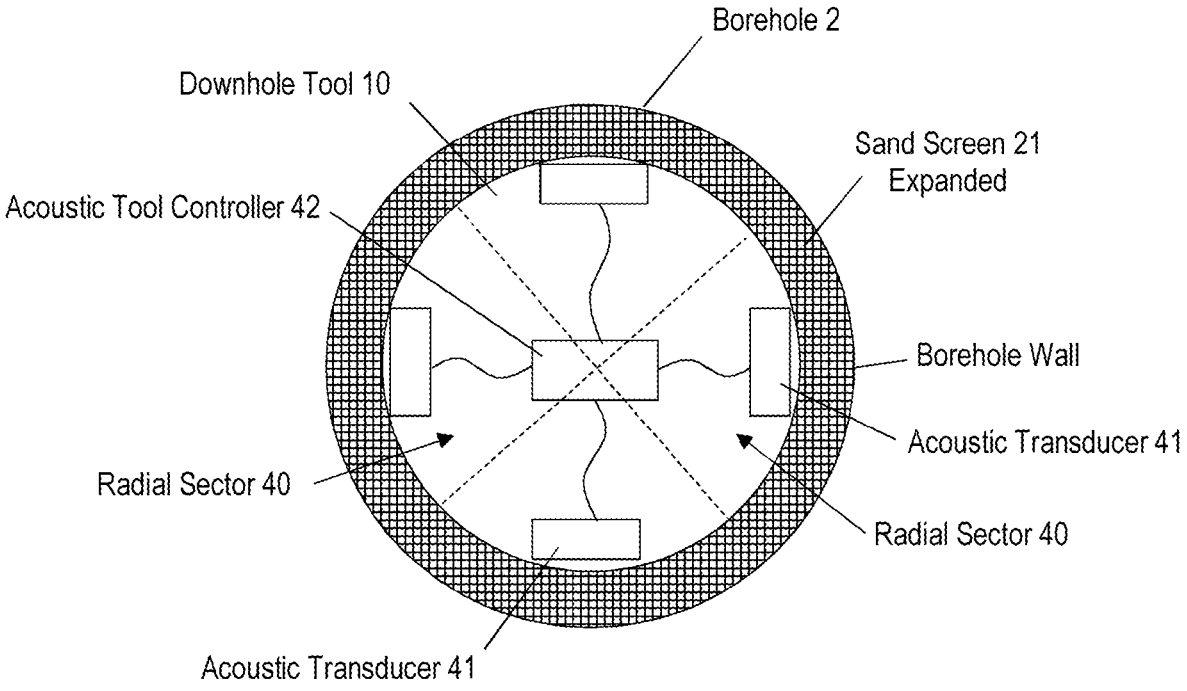
FIG. 4 depicts aspects of a downhole acoustic tool for detecting an unexpanded sand screen.

In an alternative embodiment, the downhole tool 10 in FIG. 2 can be an acoustic tool configured to emit acoustic energy (i.e., an acoustic signal) and detect reflected acoustic energy. FIG. 4 illustrates a cross-sectional view of an embodiment of the downhole tool 10 configured as an acoustic tool. The acoustic downhole tool 10 in FIG. 4 includes a plurality of sectors 40 where each sector 40 includes an acoustic transducer 41. The transducer 41 may include a transmitter transducer for transmitting an acoustic signal and a receiver transducer for receiving a reflected acoustic signal or one transducer 41 may be configured to both transmit and receive an acoustic signal. A received acoustic signal will include a component that is reflected off a wall of the borehole 2. By timing the transmission and receipt of the acoustic signal (i.e., performing time of flight measurement), the distance to the borehole wall can be determined. By comparing distances to the borehole wall from each sector 40, it can be determined if the base-pipe 20 is positioned in the center of the borehole 2 or if it is skewed with respect to a centerline of the borehole 2. A skewed base-pipe 20 provides an indication that the sand screen 21 associated with that section of the base-pipe 20 has not deployed or has not fully deployed. An acoustic tool controller 42 can control operation of the transducers 41. The computer processing system 7 or the acoustic tool controller 42 can be configured to compare the distances to the borehole wall from each sector 40. If the measured distances vary by more than a threshold value for a section of the base-pipe 20, then the computer processing system can be configured to provide a signal indicating that the sand screen 21 for that section of the base-pipe 20 has not deployed or has not fully deployed. The threshold value can be selected to ignore noise in the measuring system.

DETAILED DESCRIPTION

If it is determined that one or more sand screens 21 have not deployed or have not fully deployed, then action can be taken to activate those sand screens such as by injecting more activation fluid 12 into the borehole 2 or by directing more activation fluid 12 to those sand screens 21 that have not been satisfactorily deployed. Remedial actions such as these can be performed manually by a user or automatically by the production rig controller 6 using input from the computer processing system 7.

Figure 5:
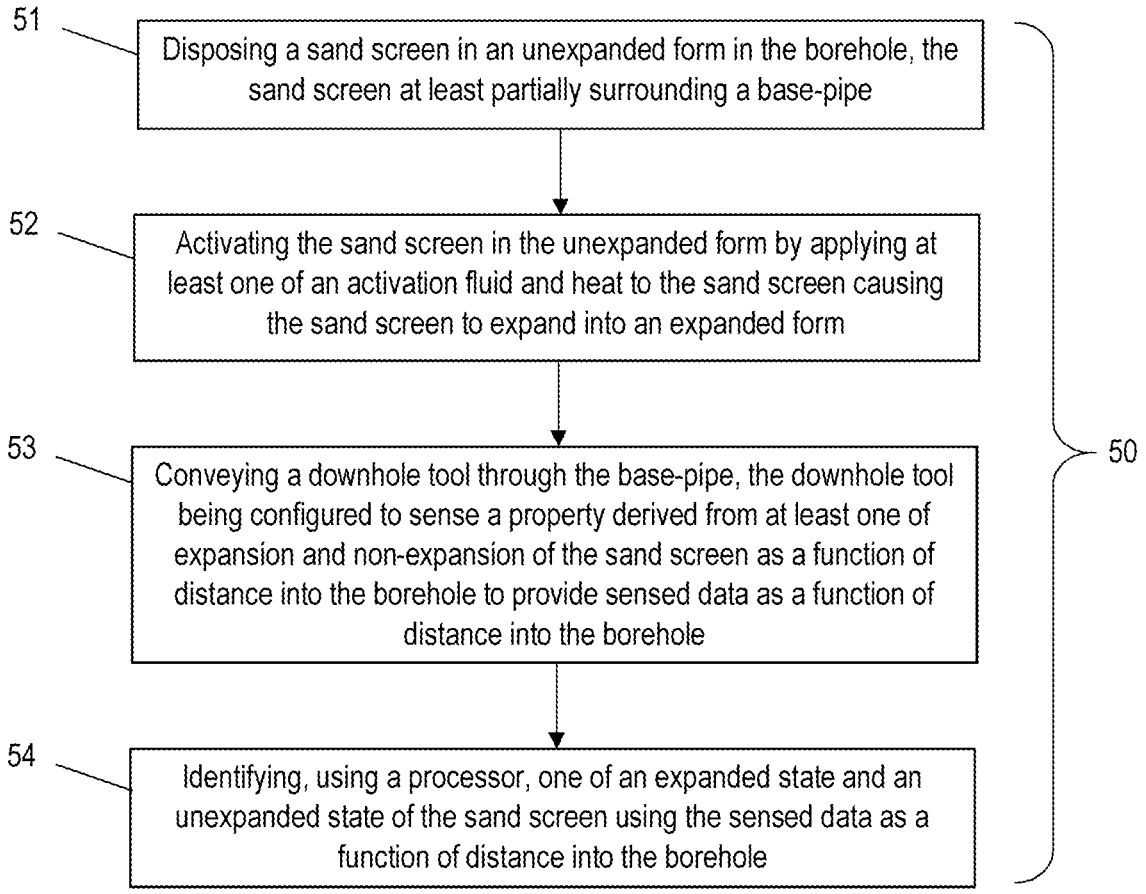
FIG. 5 is a flow chart for a method for preventing incursion of sand into the base-pipe.

FIG. 5 is a flow chart for a method 50 for deploying a sand screen in a borehole penetrating the earth. Block 51 calls for disposing the sand screen in an unexpanded form in the borehole, the sand screen at least partially surrounding a base-pipe. In one or more embodiments, the sand screen is made of a shape-memory material. The sand screen of the shape-memory material is applied to the base-pipe in an unexpanded or compressed form.

Block 52 calls for activating the sand screen in the unexpanded form by applying at least one of an activation fluid and heat to the sand screen causing the sand screen to expand into an expanded form.

Block 53 calls for conveying a downhole tool through the base-pipe, the downhole tool being configured to sense a property derived from at least one of expansion and non-expansion of the sand screen as a function of distance into the borehole to provide sensed data as a function of distance into the borehole. In one or more embodiments, the downhole tool is a survey tool configured to measure inclination and/or azimuth of the base-pipe. In an alternative embodiment, the downhole tool is an acoustic tool configured to transmit and receive acoustic energy to sense a distance from various radial sectors in the acoustic tool to a wall of the borehole.

Block 54 calls for identifying, using a processor, one of an expanded state and an unexpanded state of the sand screen using the sensed data as a function of distance into the borehole. The term "unexpanded" relates to the sand screen not being expanded or not expanded enough to perform satisfactorily as determined by a user. In the embodiment where the downhole tool is a survey tool, identifying may include comparing the sensed data to reference survey data that is obtained by conveying the survey tool through the borehole prior to the base-pipe being disposed in the borehole. Differences between the sensed data and the reference survey data that exceed a threshold value at a certain distance into the borehole indicate that the sand screen at that distance is in the non-expanded state. In the embodiment where the downhole tool is an acoustic tool, identifying may include comparing distances from radial sectors of the acoustic tool to a wall of the borehole. Differences between the distances that exceed a threshold value at a certain distance into the borehole indicate that the sand screen at that distance is in the unexpanded state. In one or more embodiments, identifying may include transmitting a signal to a signal receiving device such as a display or a controller indicating that a specific sand screen is in the non-expanded state. The specific sand screen may be identified by its distance into the borehole.

The method 50 may also include performing one or more remedial actions to activate or expand those sand screens identified as being in the non-expanded state. Non-limiting remedial actions include applying more of the activation fluid, another type of activation fluid, and/or heat to those sand screens such as by injecting more activation fluid into the borehole or applying more heat electrically via a wireline. The applying can be done manually by a user or automatically by a controller.

Set forth below are some embodiments of the foregoing disclosure:

Embodiment 1

A method for deploying a sand screen in a borehole penetrating the earth, the method comprising: disposing the sand screen in an unexpanded form in the borehole, the sand screen at least partially surrounding a base-pipe; activating the sand screen in the unexpanded form by applying at least one of an activation fluid and heat to the sand screen causing the sand screen to expand into an expanded form; conveying a downhole tool through the base-pipe, the downhole tool being configured to sense a property derived from at least one of expansion and non-expansion of the sand screen as a function of distance into the borehole to provide sensed data as a function of distance into the borehole; and identifying, using a processor, one of an expanded state and an unexpanded state of the sand screen using the sensed data as a function of distance into the borehole.

Embodiment 2

The method according to any prior embodiment, further comprising applying more activation fluid to the sand screen, applying another activation fluid to the sand screen, and/or applying heat to the sand screen in response to the sand screen being in the unexpanded state.

Embodiment 3

The method according to any prior embodiment, further comprising terminating application of the activation fluid, the another activation fluid, and/or the heat in response to the sand screen being in the expanded state.

Embodiment 4

The method according to any prior embodiment, further comprising performing a survey of the borehole comprising at least one of an inclination and an azimuth to provide reference survey data as a function of distance into the borehole using the downhole tool prior to the base-pipe being disposed in the borehole.

Embodiment 5

The method according to any prior embodiment, wherein the sensed data comprises at least one of an azimuth and an inclination of the base-pipe as a function of distance into the borehole and the method further comprises comparing the sensed data to the reference survey data as a function of distance into the borehole and identifying a difference between the sensed data and the reference survey data that exceeds a threshold value at a certain distance into the borehole.

Embodiment 6

The method according to any prior embodiment, further comprising measuring a distance from a plurality of radial sectors of the downhole tool to a wall of the borehole as a function of distance into the borehole by emitting and receiving acoustic energy to provide the sensed data as a function of distance into the borehole.

Embodiment 7

The method according to any prior embodiment, wherein the method further comprises comparing the measured distances for the radial sectors at the same distance into the borehole and identifying a difference between the measured distances that exceeds a threshold value at the same distance into the borehole.

Embodiment 8

An apparatus for deploying a sand screen in a borehole penetrating the earth, the apparatus comprising: a completion rig configured to apply at least one of an activation fluid and heat to a sand screen at least partially surrounding a base-pipe disposed in a borehole penetrating the earth, the at least one of the activation fluid and the heat causing the sand screen in an unexpanded form to expand into an expanded form; a downhole tool configured to be conveyed through the base-pipe and to sense a property derived from at least one of expansion and non-expansion of the sand screen as a function of distance into the borehole to provide sensed data as a function of distance into the borehole; and a processor configured to identify one of an expanded state and an unexpanded state of the sand screen using the sensed data as a function of distance into the borehole.

Embodiment 9

The apparatus according to any prior embodiment, wherein the completion rig is configured to apply more of the activation fluid to the sand screen, apply another type of activation fluid to the sand screen, and/or apply heat to the sand screen in response to the sand screen being in the unexpanded state.

Embodiment 10

The apparatus according to any prior embodiment, wherein the completion rig is configured to terminate application of the activation fluid, the another activation fluid, and/or the heat in response to the sand screen being in the expanded state.

Embodiment 11

The apparatus according to any prior embodiment, wherein the downhole tool is configured to perform a survey comprising at least one of an inclination and an azimuth.

Embodiment 12

The apparatus according to any prior embodiment, wherein the downhole tool is configured to perform the survey prior to the base-pipe being disposed in the borehole to provide reference survey data as a function of distance into the borehole.

Embodiment 13

The apparatus according to any prior embodiment, wherein the downhole tool comprises a centralizer.

Embodiment 14

The apparatus according to any prior embodiment, wherein the processor is further configured to compare the sensed data to the reference survey data as a function of distance into the borehole and identify a difference between the sensed data and the reference survey data that exceeds a threshold value at a certain distance into the borehole.

Embodiment 15

The apparatus according to any prior embodiment, wherein the downhole tool is configured to emit and receive acoustic energy in order to measure a distance from a plurality of radial sectors of the downhole tool to a wall of the borehole as a function of distance into the borehole to provide the sensed data as a function of distance into the borehole.

Embodiment 16

The apparatus according to any prior embodiment, wherein the method further comprises comparing the measured distances for the radial sectors at the same distance into the borehole and identifying a difference between the measured distances that exceeds a threshold value at the same distance into the borehole.

In support of the teachings herein, various analysis components may be used, including a digital and/or an analog system. For example, the production rig controller 6, the computer processing system 7, and/or the downhole tool 10 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer-readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured.

The flow diagram depicted herein is just an example. There may be many variations to this diagram or the steps operations) described therein without departing from the spirit of the invention. For instance, the steps may be performed in a differing order, or steps may be added, deleted or modified. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A method for deploying a sand screen in a borehole penetrating the earth, the method comprising:

disposing the sand screen in an unexpanded form in the borehole, the sand screen at least partially surrounding a base-pipe;

activating the sand screen in the unexpanded form by applying at least one of an activation fluid or heat to the sand screen causing the sand screen to expand into an expanded form;

conveying a downhole tool through the base-pipe, the downhole tool being configured to sense a property derived from at least one of expansion or non-expansion of the sand screen as a function of distance into the borehole to provide sensed data related to the at least one of expansion or non-expansion of the sand screen as a function of distance into the borehole, the downhole tool comprising a plurality of radial measurement sectors for measuring a distance from the base-pipe to a wall of the borehole by emitting and receiving acoustic signals using an acoustic transducer, wherein the property is sensed by transmitting and receiving signals that travel completely through the sand screen; and identifying, using a processor, one of an expanded state and an unexpanded state of the sand screen using the sensed data as a function of distance into the borehole by using the distance measurement from each radial measurement sector at the same distance in the borehole to provide a measure of at least one of tilt or displacement of the base-pipe with respect to the wall of the borehole.

2. The method according to claim 1, further comprising applying more activation fluid to the sand screen, applying another activation fluid to the sand screen, and/or applying heat to the sand screen in response to the sand screen being in the unexpanded state post-activation of the sand screen, wherein the heat is applied in addition to any previous application of heat.

3. The method according to claim 2, further comprising terminating application of the activation fluid, the another activation fluid, and/or the heat in response to the sand screen being in the expanded state post-activation of the sand screen.

4. The method according to claim 1, further comprising performing a survey of the borehole comprising at least one of an inclination and an azimuth to provide reference survey data as a function of distance into the borehole using the downhole tool prior to the base-pipe being disposed in the borehole.

5. The method according to claim 4, wherein the sensed data comprises at least one of an azimuth and an inclination of the base-pipe as a function of distance into the borehole and the method further comprises comparing the sensed data to the reference survey data as a function of distance into the borehole and identifying a difference between the sensed data and the reference survey data that exceeds a threshold value at a certain distance into the borehole.

6. The method according to claim 1, wherein the distance measured in each radial measurement sector is derived from time-of-flight of the acoustic signals.

7. The method according to claim 1, wherein the using comprises comparing the measured distances for the radial measurement sectors at the same distance into the borehole and identifying a difference between the measured distances that exceeds a threshold value at the same distance into the borehole to provide the measure of at least one of tilt or displacement of the base-pipe with respect to the wall of the borehole.

8. An apparatus for deploying a sand screen in a borehole penetrating the earth, the apparatus comprising:

a completion rig configured to apply at least one of an activation fluid or heat to a sand screen at least partially surrounding a base-pipe disposed in a borehole penetrating the earth, the at least one of the activation fluid and the heat causing the sand screen in an unexpanded form to expand into an expanded form;

a downhole tool configured to be conveyed through the base-pipe and to sense a property derived from at least one of expansion or non-expansion of the sand screen as a function of distance into the borehole to provide sensed data related to the at least one of expansion or non-expansion of the sand screen as a function of distance into the borehole, the downhole tool comprising a plurality of radial measurement sectors for measuring a distance to a wall of the borehole using an acoustic transducer, wherein the property is sensed by transmitting and receiving signals that travel completely through the sand screen; and a processor configured to identify one of an expanded state and an unexpanded state of the sand screen using the sensed data as a function of distance into the borehole by using the distance measurement from each radial measurement sector at the same distance in the borehole to provide a measure of at least one of tilt or displacement of the base-pipe with respect to the wall of the borehole.

9. The apparatus according to claim 8, wherein the completion rig is configured to apply more of the activation fluid to the sand screen, apply another type of activation fluid to the sand screen, and/or apply heat to the sand screen in response to the sand screen being in the unexpanded state post-activation of the sand screen, wherein the heat is applied in addition to any previous application of heat.

10. The apparatus according to claim 9, wherein the completion rig is configured to terminate application of the activation fluid, the another activation fluid, and/or the heat in response to the sand screen being in the expanded state, wherein the application to be terminated is post-activation of the sand screen.

11. The apparatus according to claim 8, wherein the downhole tool is configured to perform a survey comprising at least one of an inclination and an azimuth.

12. The apparatus according to claim 11, wherein the downhole tool is configured to perform the survey prior to the base-pipe being disposed in the borehole to provide reference survey data as a function of distance into the borehole.

13. The apparatus according to claim 12, wherein the downhole tool comprises a centralizer.

14. The apparatus according to claim 12, wherein the processor is further configured to compare the sensed data to the reference survey data as a function of distance into the borehole and identify a difference between the sensed data and the reference survey data that exceeds a threshold value at a certain distance into the borehole.

15. The apparatus according to claim 8, wherein the distance measured in each radial measurement sector is derived from time-of-flight of the acoustic signals.

16. The apparatus according to claim 8, wherein the using comprises comparing the measured distances for the radial measurement sectors at the same distance into the borehole and identifying a difference between the measured distances that exceeds a threshold value at the same distance into the borehole to provide the measure of at least one of tilt or displacement of the base-pipe with respect to the wall of the borehole.

* * * * *